US006012908A

United States Patent [19]

Tanaka et al.

[11] Patent Number: 6,012,908

[45] Date of Patent: Jan. 11, 2000

[54] ELECTRICALLY OPERATED SEAL COMPRESSOR HAVING A REFRIGERANT FLOW BRANCH TUBE WITH A CHAMBER DISPOSED IN THE VICINITY OF A SUCTION PORT

[75] Inventors: Yasuhiko Tanaka, Nara; Ichiro Kita, Shiki-gun; Ikutomo Umeoka, Nara, all of Japan

[73] Assignee: Matsushita Refrigeration Company, Osaka, Japan

[21] Appl. No.: 08/913,635

[22] PCT Filed: Jan. 22, 1997

[86] PCT No.: PCT/JP97/00130

§ 371 Date: Sep. 19, 1997

§ 102(e) Date: Sep. 19, 1997

[87] PCT Pub. No.: WO97/27402

PCT Pub. Date: Jul. 31, 1997

[30] Foreign Application Priority Data

| | | | |
|---|---|---|---|
| Jan. 23, 1996 | [JP] | Japan | 8-008896 |
| Feb. 26, 1996 | [JP] | Japan | 8-037726 |
| Feb. 26, 1996 | [JP] | Japan | 8-037730 |

[51] Int. Cl.[7] ..... F04B 39/00

[52] U.S. Cl. ..... 417/312

[58] Field of Search ..... 417/312

[56] References Cited

U.S. PATENT DOCUMENTS

| | | | |
|---|---|---|---|
| 2,297,046 | 9/1942 | Bourne | 181/48 |
| 3,664,769 | 5/1972 | Knudsen et al. | 417/312 |
| 4,239,461 | 12/1980 | Elson | 417/312 |
| 4,759,693 | 7/1988 | Outzen | 417/312 |
| 4,813,852 | 3/1989 | Ikeda et al. . | |
| 5,129,793 | 7/1992 | Blass et al. | 417/312 |
| 5,213,125 | 5/1993 | Leu . | |
| 5,288,212 | 2/1994 | Lee | 417/312 |
| 5,304,044 | 4/1994 | Wada et al. | 417/312 |
| 5,328,338 | 7/1994 | Hirano et al. . | |
| 5,496,156 | 3/1996 | Harper et al. | 417/312 |
| 5,584,674 | 12/1996 | Mo | 417/312 |

FOREIGN PATENT DOCUMENTS

| | | |
|---|---|---|
| 561 383 | 9/1993 | European Pat. Off. . |
| 582 712 | 2/1994 | European Pat. Off. . |
| 62-218683 | 9/1987 | Japan . |
| 2040089 | 2/1990 | Japan . |
| 3-175165 | 7/1991 | Japan . |
| 3-175174 | 7/1991 | Japan . |
| 4-124476 | 4/1992 | Japan . |
| 6-74786 | 9/1994 | Japan . |
| 21 18 256 | 10/1983 | United Kingdom . |

*Primary Examiner*—Charles G. Freay
*Assistant Examiner*—Robert Z. Evora
*Attorney, Agent, or Firm*—Wenderoth, Lind & Ponack, L.L.P.

[57] ABSTRACT

An electrically-operated sealed compressor includes a cylinder, a cylinder head mounted on the cylinder and having a suction chamber and first and second discharge chambers, a piston accommodated in the cylinder, and a valve mechanism. The valve mechanism includes a suction muffler and a valve plate having at least one suction port, first and second discharge ports, and first and second pass holes. The first discharge port and the first pass hole communicate with the first discharge chamber, while the second discharge port and the second pass hole communicate with the second discharge chamber. The valve mechanism also includes first and second discharge valves mounted on the valve plate and accommodated in the first and second discharge chambers, respectively, a suction reed having a reed valve for selectively opening and closing the suction port, a discharge gasket for sealing the valve plate and the cylinder head, and a discharge muffler. The first and second discharge chambers are separated from each other by the discharge gasket to form respective independent spaces, while the first and second pass holes communicate with the discharge muffler.

10 Claims, 14 Drawing Sheets

ELECTRICALLY OPERATED SEAL COMPRESSOR HAVING A REFRIGERANT FLOW BRANCH TUBE WITH A CHAMBER DISPOSED IN THE VICINITY OF A SUCTION PORT

TECHNICAL FIELD

The present invention relates generally to a relatively compact compressor such as utilized in a refrigerator for home use or a freezer and, more particularly, to a valve mechanism or a suction system of such a compressor.

BACKGROUND ART

In recent years, valve mechanism compressors have been improved in numerous ways to increase the efficiency of the compressors. However, demands have also been made from the market not only to increase the efficiency of the compressors, but also to suppress noise emission from the compressors.

The prior art compressor valve mechanism is disclosed in, for example, the Japanese Laid-open Patent Publication (unexamined) No. 3-175174.

Hereinafter, with reference to FIGS. 24, 25 and 26, the prior art compressor valve mechanism disclosed in the above mentioned Japanese Laid-open Patent Publication No. 3-175174 will be discussed.

FIG. 24 is a sectional view of the prior art valve mechanism in an assembled condition taken along the horizontal direction. FIG. 25 is a longitudinal sectional view of FIG. 24, and FIG. 26 is an exploded view of the prior art valve mechanism. In FIGS. 24 to 26, reference numeral 1 represents the valve mechanism, and reference numeral 4 represents a valve plate having two suction ports 2 and two discharge ports 3 both defined therein. A discharge reed valve 22 for selectively opening and closing the discharge ports 3 is retained within a recess 21 defined in the valve plate 4. Reference numeral 23 represents a stopper rivetted at 24 to the valve plate for regulating the lift of the reed valve 22. A suction reed valve 11, a plate-like gasket 12, the valve plate 4, a head gasket 13 and a cylinder head 14 are all bolted to a cylinder 10.

The cylinder 10 accommodates therein a piston drivingly coupled with an electric motor (not shown) for axial reciprocating movement within the cylinder 10. The cylinder head 14 has a suction chamber 25 and a discharge chamber 26 defined therein in cooperation with the valve plate 4.

The operation of the prior art compressor valve mechanism of the structure described above will now be described.

As a result of reciprocating movement of a piston 15, a refrigerant gas within the suction chamber 25 is sucked into the cylinder 10 through the suction ports 2 in the valve plate 4 during opening of the suction reed valve 11 and is subsequently compressed within the cylinder 10 before it is discharged into the discharge chamber 26 in the cylinder head 14 through the discharge ports 3 during opening of the discharge reed valve 22.

In the prior art valve mechanism discussed above, however, because the refrigerant gas is simultaneously discharged into the discharge chamber 26 through the two discharge ports 3, refrigerant gas flows interfere with each other to hinder smooth streams of the refrigerant gas, thus lowering the discharge efficiency and the performance of the compressor. Furthermore, because simultaneous discharge of the refrigerant gas from the two discharge ports 3 into the discharge chamber 26 is intermittently performed, very large pressure pulsations and noises are undesirably generated.

Also, the discharge reed valve merely has only one resonant mode as streams of the refrigerant gas discharged respectively from the two discharge ports 3 push the discharge reed valve 22 simultaneously. Therefore, it has been difficult to make resonance of the reed valve 22 proper and also to optimize the discharge efficiency at about 3,000 revolutions per minute at 50 Hz and also at about 3,600 revolutions per minute at 60 Hz. Also, even in the case of the compressor in which the number of revolutions per minute is varied such as an inverter, there has been a problem in that changes in number of revolutions per minute tend to be accompanied by considerable lowering of the efficiency.

In addition, since the discharge reed valve 22 merely has the single resonant mode, there has been another problem in that hissing sounds generated by the respective streams of the refrigerant gas discharged from the two discharge ports tend to be enhanced by interference to thereby result in considerable generation of noise.

Also, the discharge reed valve 22 is fixed in position within the recess 21 by the stopper 23 and the rivets 24, requiring a complicated mounting and an inefficient assemblage.

Japanese Patent Publication (examined) No. 6-74786 discloses a suction system for an electrically-operated sealed compressor in which a muffler having a plurality of chambers partitioned from each other is employed for muffling. However, there has been a problem in that if the muffling feature is given priority, the suction efficiency tends to be lowered accompanied by reduction in performance.

Also, since a sucked gas represents an intermittent flow as a result of selective opening and closing of a reed valve, a flow inertia of a refrigerant gas cannot be sufficiently utilized and the charge on a cylinder tends to be lowered. This tendency is enhanced when the muffling performance of the muffler is increased.

This sealed compressor requires the muffling performance of the muffler and the suction efficiency to be improved.

The present invention has been developed to overcome the above-described disadvantages.

It is accordingly an objective of the present invention to provide an improved electrically-operated sealed compressor which has a high discharge efficiency and in which sounds generated as a result of interference between discharged refrigerant gases are of a low level to accomplish noise suppression, and in which pulsation of the refrigerant gas is very small.

Another objective of the present invention is to provide an electrically-operated sealed compressor capable of accommodating changes in number of revolutions.

A still further objective of the present invention is to provide an electrically-operated sealed compressor in which the discharge valve can easily be mounted to facilitate assemblage.

Another objective of the present invention is to provide an electrically-operated sealed compressor in which the stopper and the discharge valve can easily be fixed in position.

Still another objective of the present invention is to provide an electrically-operated sealed compressor capable of improving and maintaining the compressing performance of the compressor in a muffler without lowering the flow inertia of the refrigerant even if the charge on the cylinder is improved and, hence, the muffling performance is increased.

DISCLOSURE OF THE INVENTION

In accomplishing the above and other objectives, an electrically-operated sealed compressor according to the present invention comprises a cylinder, a cylinder head mounted on the cylinder and having a suction chamber defined therein and first and second discharge chambers defined therein, a piston accommodated in the cylinder, and a valve mechanism. The valve mechanism comprises a suction muffler and a valve plate having at least one suction port defined therein, first and second discharge ports defined therein, and first and second pass holes defined therein. The first discharge port and the first pass hole communicate with the first discharge chamber, while the second discharge port and the second pass hole communicate with the second discharge chamber. The valve mechanism also comprises first and second discharge valves mounted on the valve plate and accommodated in the first and second discharge chambers, respectively, a suction reed having a reed valve for selectively opening and closing the suction port, a discharge gasket for sealing the valve plate and the cylinder head, and a discharge muffler. The first and second discharge chambers are separated from each other by the discharge gasket to form respective independent spaces, while the first and second pass holes communicate with the discharge muffler.

This construction eliminates interference of refrigerant gas flows which has been hitherto caused by simultaneous introduction of refrigerant gas into a single discharge chamber through two discharge holes, and thus avoiding a lowering of the discharge efficiency.

Advantageously, the first and second discharge chambers have different volumes and, hence, the frequencies of pulsation differ in the first and second discharge chambers, thus avoiding an increase in noise which may be caused by a resonance of refrigerant gas flows flowing into the discharge muffler at the same frequency of pulsation.

Again advantageously, the first and second pass holes have different diameters. By so doing, refrigerant gas flows pass through the first and second pass holes at different speeds. Hence, the refrigerant gas flows have different frequencies of pulsation when entering the discharge muffler, and thus avoiding an increase in noise which may be caused by a resonance of refrigerant gas flows flowing into the discharge muffler at the same frequency of pulsation.

The cylinder head may have a mixing chamber defined therein, while the valve plate may have a pass hole defined therein so as to communicate with the mixing chamber and the discharge muffler. In this case, the first and second discharge chambers are substantially separated from the mixing chamber by the discharge gasket but communicate with the mixing chamber via first and second communication holes defined in the cylinder head.

This construction is free from a lowering in discharge efficiency which has been hitherto caused by mutual interference of refrigerant gas flows intermittently passing through the two discharge ports. Also, because the mixing chamber acts to reduce and rectify the refrigerant gas flowing towards the discharge muffler, pulsation of the refrigerant gas is relatively small and the refrigerant gas flows are smooth. Thus noise generation is considerably reduced.

In another form of the present invention, an electrically-operated sealed compressor comprises a cylinder, a cylinder head mounted on the cylinder and having a suction chamber defined therein and a discharge chamber defined therein, a piston accommodated in the cylinder, and a valve mechanism. The valve mechanism comprises a valve plate having at least one suction port defined therein and first and second discharge ports defined therein. The suction port confronts the suction chamber, while the first and second discharge ports confront the discharge chamber. The valve mechanism also comprises first and second discharge valves mounted on the valve plate and accommodated in the discharge chamber for selectively opening and closing the first and second discharge ports, and a suction reed having a reed valve confronting the suction port for selectively opening and closing the suction port. The first and second discharge valves are connected at a valve end and formed integrally therewith. The first and second discharge valves are fixed to the valve plate with the valve end secured thereto.

The above-described construction facilitates assemblage of the discharge valves at respective positions corresponding to the associated discharge ports, accompanied by a favorable workability.

Advantageously, the first and second discharge valves have different lengths as measured from the valve end or have different widths. This construction exhibits a favorable discharge efficiency and minimizes noise of interference of the refrigerant gases. More specifically, the first and second discharge valves have different frequencies of vibration so that the first and second discharge valves exhibit different resonance when the refrigerant gases flow therethrough which are appropriate to the resonance at the different numbers of revolutions per minute while preventing any possible increase in hissing sound resulting from the interference with each other.

The electrically-operated sealed compressor may comprise first and second stoppers mounted on the valve plate for regulating lifts of the respective first and second discharge valves. The first and second stoppers are connected at a stopper end and formed integrally therewith. The first and second discharge valves are fixed to the valve plate with the valve end secured thereto by the stopper end. By this construction, the two discharge valves and the two stoppers can be easily fixed at their appropriate positions.

Advantageously, the first and second stoppers have different angles of inclination as measured from a bend in the stopper end, or the first and second discharge valves have different lengths as measured from the bend in the stopper end to a free end of each stopper. By this construction, the first and second discharge valves can easily have different lifts and, in view of the possession of the different lifts, the first and second discharge valves behave differently when the refrigerant gases flow therethrough to thereby render the discharge efficiency to be proper and also to minimize noise emission resulting from interference with each other.

Each of the first and second stoppers may have a retaining portion of a different length for depressing the associated discharge valve. This construction has an effect that the effective valve length of the first discharge valve and the effective valve length of the second discharge valve can be easily rendered to have different values. The first and second discharge valves exhibit different resonance when the refrigerant gases flow therethrough which are appropriate to the resonance at the different numbers of revolutions per minute while preventing any possible increase in hissing sound resulting from the interference with each other.

The valve plate may have a recess defined therein for accommodating the first and second discharge valves. In this case, the first and second discharge valves are fixed to the valve plate with the valve end secured thereto by the stopper end by allowing the stopper end to be press-fitted into the recess. This construction has an effect that the discharge valves can easily be fixed by press-fitting the stopper end in the recess. Also, a fixed portion press-fitted in the recess easily constitutes a partition for the first and second discharge chambers.

In a further form of the present invention, an electrically-operated sealed compressor comprises a sealed casing, compressor elements accommodated in the sealed casing and having an electric motor, a cylinder, a piston, and a crankshaft, a suction muffler accommodated in the sealed casing, a valve plate mounted on one of the compressor elements and having a suction port defined therein, a reed valve for selectively opening and closing the suction port, a passage extending from the suction port to the suction muffler, and a refrigerant flow branch tube opening into a portion of the passage for allowing a sucked gas to flow thereinto and flow out therefrom.

The above-described construction has sich a function that during closure of the reed valve, the flow inertia in the suction passage is held by the refrigerant flow branch tube. During opening of the reed valve, a refrigerant gas accumulated by the refrigerant flow branch tube flows into the cylinder to maintain the flow inertia of the sucked gas to thereby maintain and improve the efficiency of charge of the refrigerant into the cylinder.

The refrigerant flow branch tube may be accommodated in the suction muffler. This construction in addition to the function of maintaining the flow inertia of the sucked refrigerant gas, has, a capability of simplifying the structure.

Another refrigerant flow branch tube may be provided to improve an optimum suction efficiency according to the number of revolutions per minute. According to this construction, the flows of the refrigerant into and out from the refrigerant flow branch tubes during selective opening and closing of the reed valve can be improved by causing a gas column within each refrigerant flow branch tube to resonate according to the number of revolutions of the compressor. Thereby maintain and improve the efficiency of charge of the refrigerant into the cylinder at a particular number of revolutions per minute.

Preferably, the refrigerant flow branch tube has an opening disposed in the vicinity of or adjacent to the suction port. This construction has such a function that the flow inertia can be maintained up to the vicinity of the suction port to thereby maintain and improve the efficiency of charge of the refrigerant into the cylinder.

Again preferably, the suction muffler has a refrigerant intake port having a cross-sectional area smaller than the suction port. According to this construction, while maintaining the efficiency of charge of the refrigerant into the cylinder, the muffling performance of the muffler can be improved by the refrigerant flow branch tube.

In another form of the present invention, an electrically-operated sealed compressor comprises a sealed casing, compressor elements accommodated in the sealed casing and having an electric motor, a cylinder, a piston, and a crankshaft, a suction muffler accommodated in the sealed casing, a valve plate mounted on one of the compressor elements and having a suction port defined therein, a reed valve for selectively opening and closing the suction port, a passage extending from the suction port to the suction muffler, and a closed small chamber formed so as to open into the passage through a branch tube for allowing a sucked gas to flow thereinto and flow out therefrom.

Another closed small chamber may be formed so as to open into the passage through another branch tube for allowing a sucked gas to flow thereinto and flow out therefrom.

The closed small chamber may be accommodated in the suction muffler.

Advantageously, the closed small chamber is open into the passage in the vicinity of the suction port.

It is preferred that the suction muffler has an intake port defined therein and having a cross-sectional area smaller than the suction port.

According to the above-described construction, when the reed valve opens during a suction stroke, a gas flows into the cylinder and, during subsequent compression stroke, the reed valve is closed. At this time, the internal pressure within the passage leading from the interior of the muffler to the suction port is increased because the flow is abruptly interrupted. The gas of the increased internal pressure is accommodated within the closed small chamber through the branch tube. Accordingly, the inertia of flow can be maintained. Then, during the suction stroke, the accumulated gas immediately flows into the cylinder to give rise to a smooth sucked flow while avoiding reduction of the flow inertia.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Hereinafter, various embodiments of the present invention will be described with reference to the attached figures.

Embodiment 1

Figure 1:
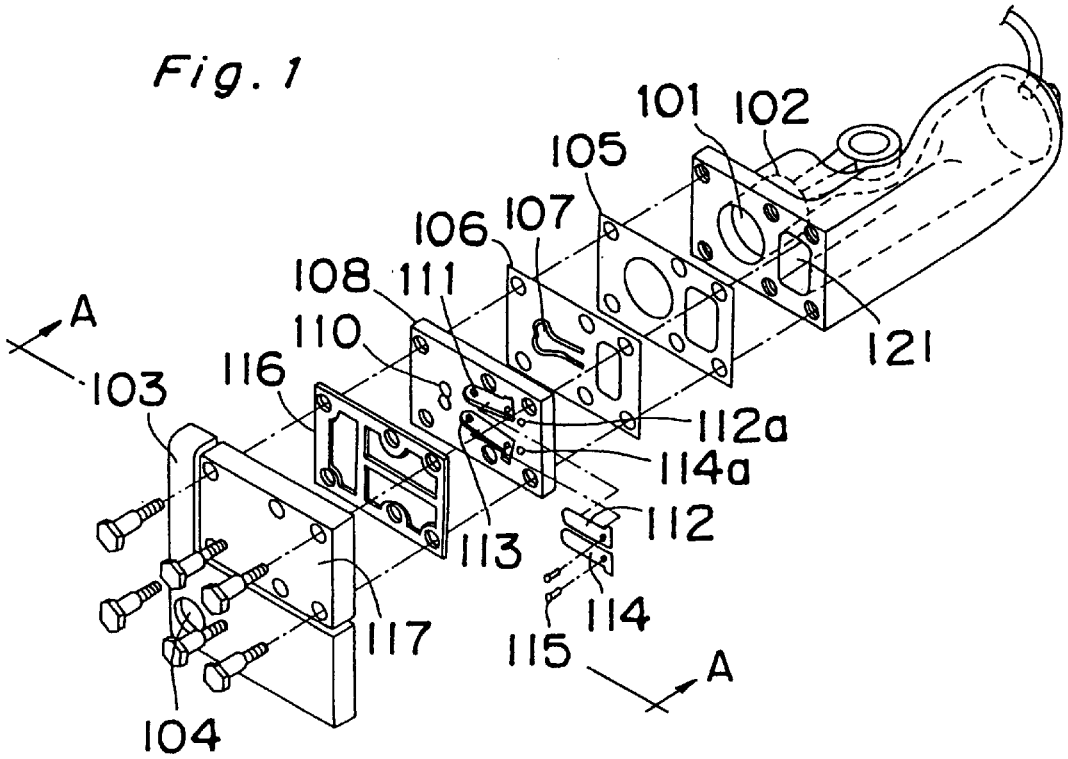
FIG. 1 is an exploded perspective view of a compressor valve mechanism according to a first embodiment of the present invention.
Figure 2:
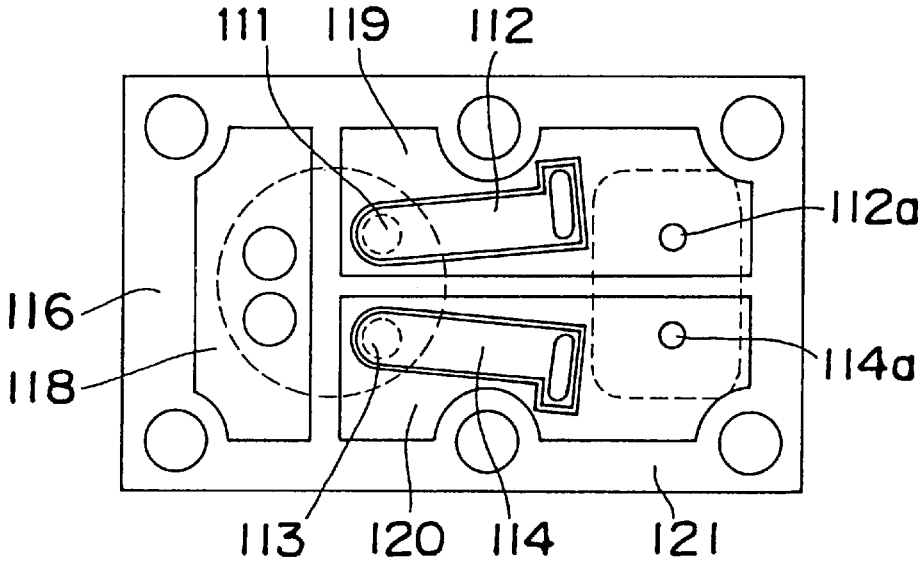
FIG. 2 is a sectional view of an essential portion of the valve mechanism of FIG. 1.

FIG. 1 is an exploded view of a compressor valve mechanism according to a first embodiment of the present invention, while FIG. 2 is a cross-sectional view of an essential portion of the valve mechanism as viewed from an arrow A in FIG. 1.

In FIGS. 1 and 2, reference numeral 101 represents a piston operable to compress a refrigerant gas in a space within a cylinder 102 when it reciprocatingly moves within the cylinder 102. Reference numeral 103 represents a muffler having a muffler intake port 104 defined therein for sucking the refrigerant gas.

Reference numeral 105 represents a suction gasket, and reference numeral 106 represents a suction reed having a reed valve 107. Reference numeral 108 represents a valve plate having two suction ports 110 defined therein in alignment with the reed valve 107. Also, the valve plate 108 includes a first discharge port 111, a first discharge valve 112 for selectively opening and closing the first discharge port 111, a first pass hole 112*a*, a second discharge port 113, a second discharge valve 114 for selectively opening and closing the second discharge port 113, and a second pass hole 114*a*. The first and second discharge valves 112 and 114 are secured to the valve plate 108 by means of fasteners 115.

Reference numeral 116 represents a discharge gasket interposed between the valve plate 108 and a cylinder head 117. By the effect of sealing of the discharge gasket 116, a suction chamber 118 communicating with the suction ports 110 and first and second discharge chambers 119 and 120 respectively communicating with the discharge ports 111 and 113 are formed. The first discharge chamber 119 accommodates the first discharge valve 112 and communicates with the first pass hole 112*a*, while the second discharge chamber 120 accommodates the second discharge valve 114 and communicates with the second pass hole 114*a*. Both the first and second pass holes 112*a* and 114*a* communicate with the discharge muffler 121.

The operation and the effect of the compressor valve mechanism constructed as hereinabove described will now be discussed.

As a result of reciprocating movement of the piston 101, a refrigerant gas is introduced from the muffler intake port 104 into the suction chamber 118 through the suction muffler 104 and then drawn into the cylinder 102 from the suction ports 110 by the effect of selective opening and closing of the reed valve 107.

The refrigerant gas compressed within the cylinder 102 is discharged into the first and second discharge chambers 119 and 120 after having flowed through the first and second discharge ports 111 and 1 13 by the effect of selective opening and closing of the first and second discharge valves 112 and 114. Because the first and second discharge chambers 119 and 120 are formed separately, refrigerant gas flows generated by the discharge do not interfere with each other around the first and second discharge valves 112 and 114 and, hence, the refrigerant gas flows smoothly through the first and second discharge ports 111 and 113. Accordingly, a lowering of the discharge efficiency can be avoided which has been hitherto caused by an interference between a flow around the first discharge valve 112 and another flow around the second discharge valve 114.

As described hereinabove, the compressor of the present invention comprises the piston 101, the cylinder 102 accommodating the piston 101, the reed valve 107 for selectively opening and closing the suction muffler 103 and suction ports 110, the valve plate 108 having two discharge ports 111 and 113 and two pass holes 112*a* and 114*a*, two discharge valves 112 and 114 mounted on the valve plate 108, the cylinder head 117 having the suction chamber 118 and two discharge chambers 119 and 120, a discharge gasket 116 for sealing the valve plate 108 and the cylinder head 117, and the discharge muffler 121. The first discharge chamber 119 accommodates the first discharge valve 112 and communicates with the first discharge port 111 and the first pass hole 112*a*, while the second discharge chamber 120 accommodates the second discharge valve 114 and communicates with the second discharge port 113 and the second pass hole 114*a*. Also, the first and second discharge chambers 119 and 120 are completely separated from each other by the discharge gasket 116 to form respective independent spaces, while both the first and second pass holes 112*a* and 114*a* communicate with the discharge muffler 121. This construction eliminates interference of refrigerant gas flows which has been hitherto caused by simultaneous introduction of refrigerant gas into a single discharge chamber through two discharge holes, thus avoiding a lowering of the discharge efficiency.

Figure 3:
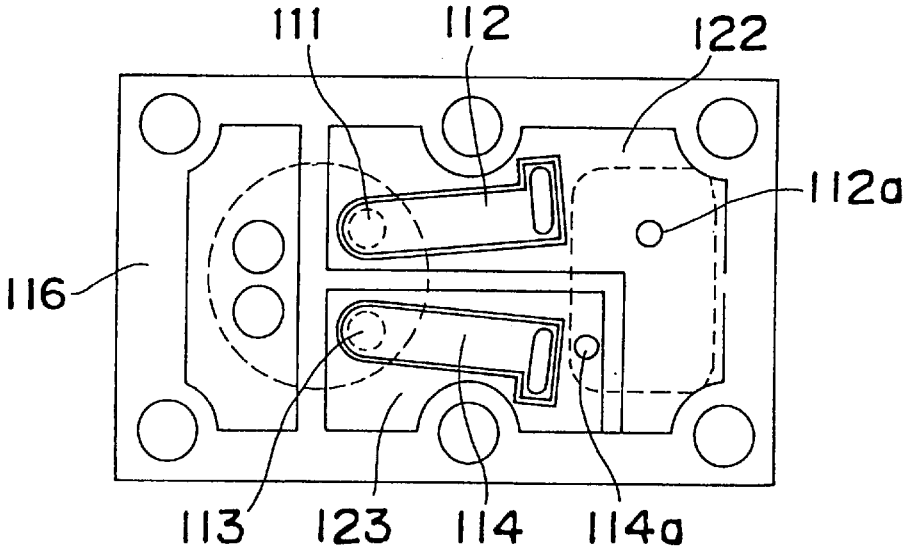
FIG. 3 is a view similar to FIG. 2, but depicting a modification thereof.

As shown in FIG. 3, first and second discharge chambers 122 and 123 may have different volumes, unlike the embodiment shown in FIGS. 1 and 2.

In the above-described construction, a refrigerant gas is discharged into the first and second discharge chambers 122 and 123 through the first and second discharge ports 111 and 113 by the effect of selective opening and closing of the first and second discharge valves 112 and 114.

It is to be noted here that intermittent discharge of the refrigerant gas tends to generate an undesirable pressure pulsation in the discharge chambers, and a relatively large pulsation causes, as a pulsation source, an increase in vibration or noise. According to the present invention, however, because the first and second discharge chambers 122 and 123 have different volumes and, hence, have different frequencies of pulsation, the refrigerant gas flows into the discharge muffler 121 through the first and second pass holes 112*a* and 114*a* at the different frequencies of pulsation, thus avoiding an increase in noise which may be caused by a resonance of the refrigerant gas flows flowing into the discharge muffler at the same frequency of pulsation. Also, the pulsation in the discharge muffler can be considerably reduced by appropriately determining the volumes of the first and second discharge chambers 122 and 123.

Figure 4:
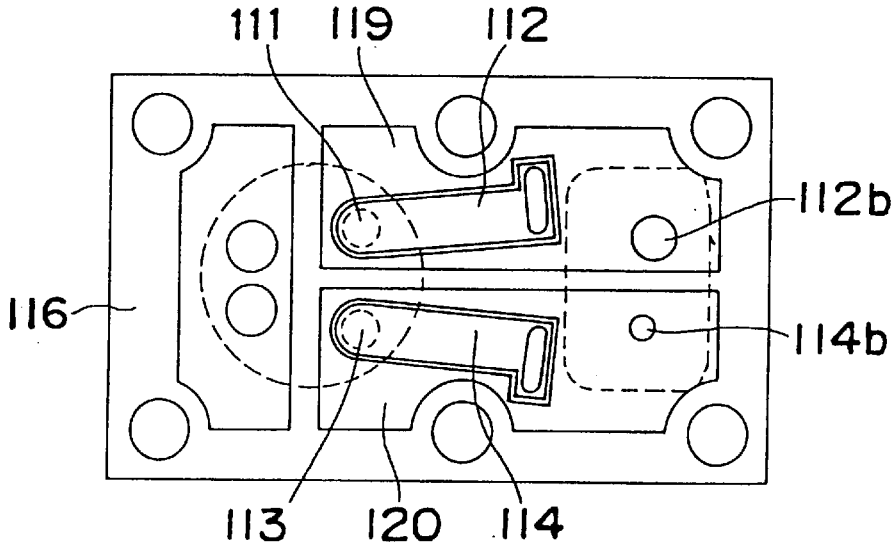
FIG. 4 is a view similar to FIG. 2, but depicting another modification thereof.

As shown in FIG. 4, first and second pass holes 112*b* and 114*b* may have different diameters.

By the above-described construction, a refrigerant gas is discharged into the first and second discharge chambers 122 and 123 through the first and second discharge ports 111 and 113 by the effect of selective opening and closing of the first and second discharge valves 112 and 114. Thereafter, the refrigerant gas in the first and second discharge chambers 122 and 123 is discharged into the discharge muffler 121 through the first and second pass holes 112*b* and 114*b* . Because the two pass holes 112*b* and 114*b* have different diameters, refrigerant gas flows pass therethrough at different speeds. Accordingly, the refrigerant gas flows have different frequencies of pulsation when entering the discharge muffler 121, thus avoiding an increase in noise which may be caused by the resonance of refrigerant gas flows flowing into the discharge muffler at the same frequency of pulsation.

Figure 5:
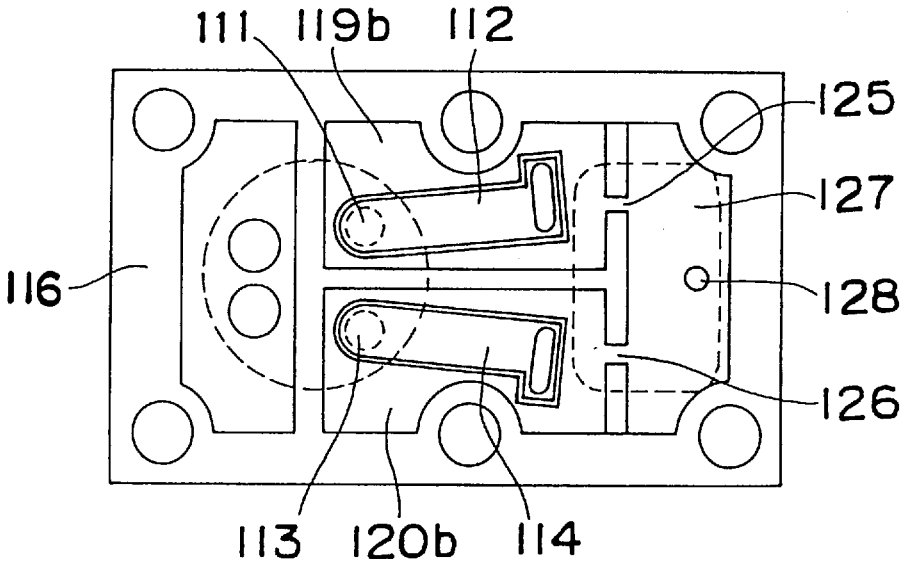
FIG. 5 is a view similar to FIG. 2, but depicting a further modification thereof.

As shown in FIG. 5, the cylinder head 117 may have a mixing chamber 127 defined therein, which communicates with first and second discharge chambers 119*b* and 120*b* through first and second communication holes 125 and 126, respectively. The mixing chamber 127 also communicates with the discharge muffler 121 through a pass hole 128.

By the above-described construction, a refrigerant gas is discharged into the first and second discharge chambers 119*b* and 120*b* through the first and second discharge ports 111 and 113 by the effect of selective opening and closing of the first and second discharge valves 112 and 114. Because the first and second discharge chambers 119*b* and 120*b* are separated from each other, refrigerant gases discharged thereinto do not interfere with each other and, hence, do not lower the discharge efficiency. The refrigerant gases in the first and second discharge chambers 119*b* and 120*b* are then introduced into the mixing chamber 127 after having been throttled by the first and second communication holes 125 and 126. Because the discharge of the refrigerant gases is intermittently performed, they pulsate. However, because the refrigerant gases are throttled by the first and second communication holes 125 and 126, such pulsation is relatively small. Furthermore, the mixing chamber 127 acts to alleviate intermittent gas flow into the discharge muffler 121 through the pass hole 128. Accordingly, pulsation inside the discharge muffler 121 is reduced and the refrigerant gas flows smoothly, thus considerably reducing noise generation.

It is to be noted here that although in the above-described embodiment the valve plate 108 has been described as having two suction ports 110, it may have only one suction port.

Embodiment 2

Hereinafter, a second embodiment of the, present invention will be described with reference to FIGS. 6 to 14.

Figure 6:
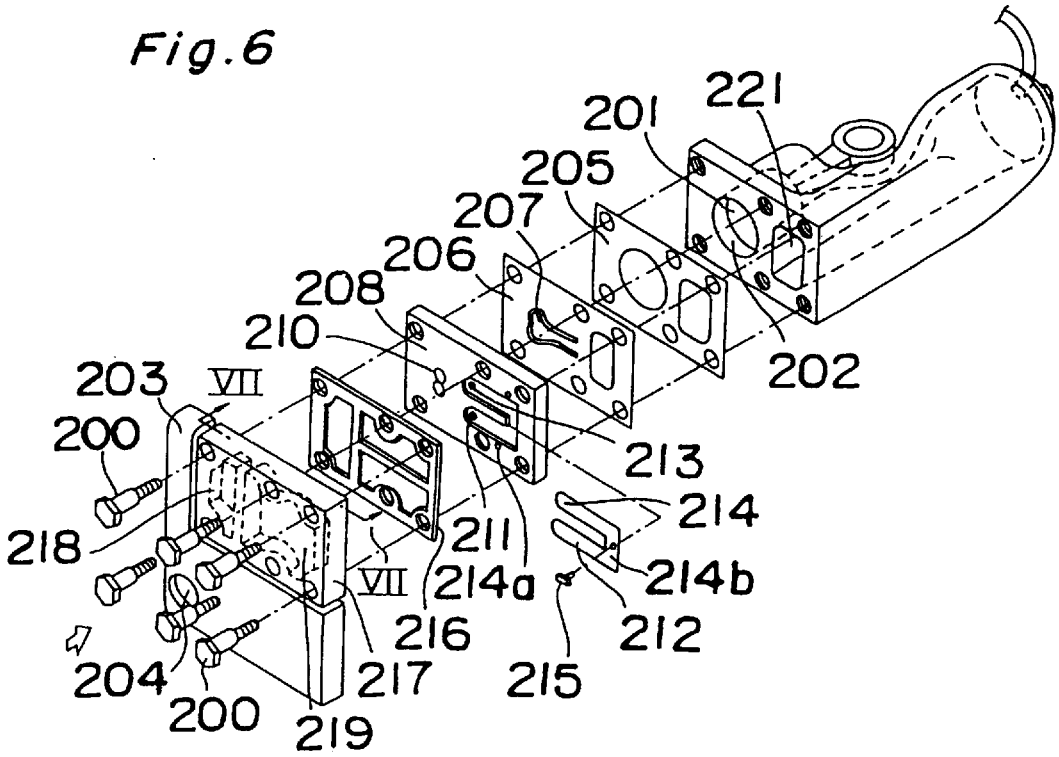
FIG. 6 is an exploded perspective view of a compressor valve mechanism according to a second embodiment of the present invention.
Figure 7:
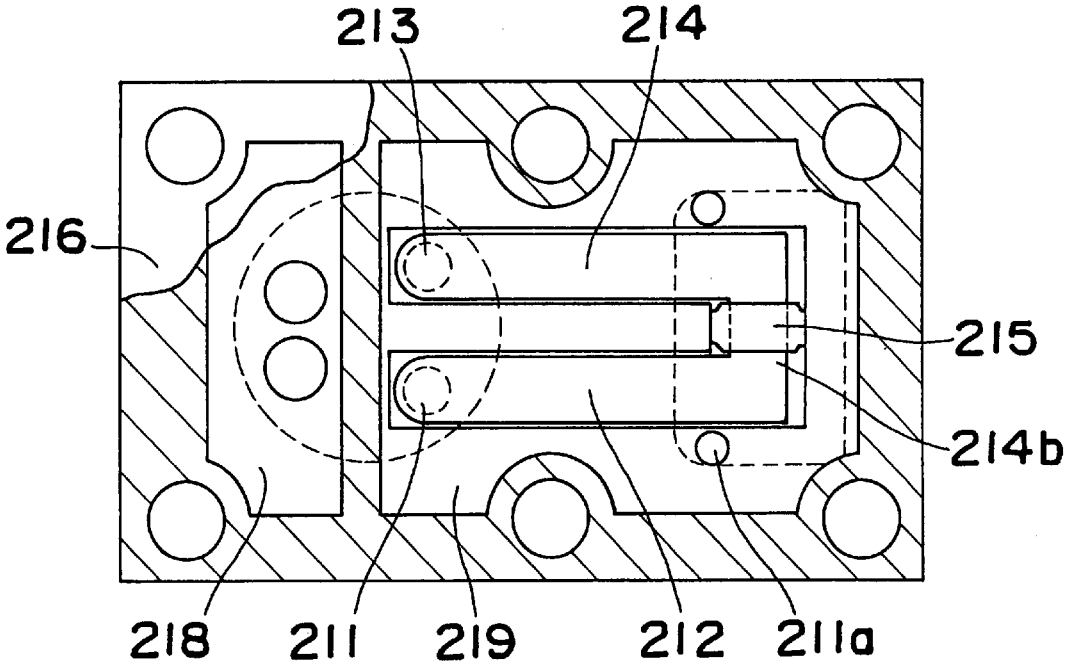
FIG. 7 is a sectional view taken along line VII—VII in FIG. 6.

FIG. 6 is an exploded view of a compressor valve mechanism according to the second embodiment of the present invention, while FIG. 7 is a cross-sectional view of an essential portion taken along line VII—VII in FIG. 6.

In FIGS. 6 and 7, reference numeral 201 represents a piston operable to compress a refrigerant gas in a space within a cylinder 202 when it reciprocatingly moves within the cylinder 202. Reference numeral 203 represents a muffler having a muffler intake port 204 defined therein for sucking the refrigerant gas.

Reference numeral 205 represents a suction gasket, and reference numeral 206 represents a suction reed having a reed valve 207. Reference numeral 208 represents a valve plate having two suction ports 210 defined therein in alignment with the reed valve 207. Also, the valve plate 208 includes a first discharge port 211, a first discharge valve 212 for selectively opening and closing the first discharge port 211, a second discharge port 21.3, a second discharge valve 214 for selectively opening and closing the second discharge port 213, and pass holes 214*a*.

The first and second discharge valves 212 and 214 are connected with each other by means of a valve end 214*b* and are formed integrally therewith with the valve end 214*b* secured to the valve plate 208 by means of a fastener 215.

Reference numeral 216 represents a discharge gasket interposed between the valve plate 208 and a cylinder head 217. By the effect of sealing of the discharge gasket 216, a suction chamber 218 confronting the suction port 210 and a discharge chamber 219 confronting the discharge ports 211 and 213 are formed in the cylinder head 217. The discharge chamber 219 communicates with a discharge muffler 221 via the pass holes 214*a*.

The suction reed 206, the valve plate 208 and the cylinder head 217 are sequentially overlapped and mounted to an end face of the cylinder 202 by means of bolts 200.

The operation and the effect of the compressor valve mechanism constructed as hereinabove described will now be discussed.

As a result of reciprocating movement of the piston 201, a refrigerant gas is introduced from the muffler intake port 204 into the suction chamber 218 through the suction muffler 203 and then drawn into the cylinder 202 by the effect of selective opening and closing of the reed valve 207.

The refrigerant gas compressed within the cylinder 202 is discharged into the discharge chamber 219 after having flowed through the first and second discharge ports 211 and 213 by the effect of selective opening and closing of the first and second discharge valves 212 and 214 and then flows into the discharge muffler 221 through the pass holes 214*a*.

In FIG. 7, because the first and second discharge valves 212 and 214 are integrally formed with each other in the form as connected through the valve end 214*b*, it has an effect that mere securement of the valve end 214*b* to the valve plate 208 through the fastener 215 makes it possible to install the first and second discharge valves 212 and 214 accurately and easily at respective positions aligned with the first and second discharge ports 211 and 213 and, therefore, assembly can be extremely easily carried out.

Figure 8:
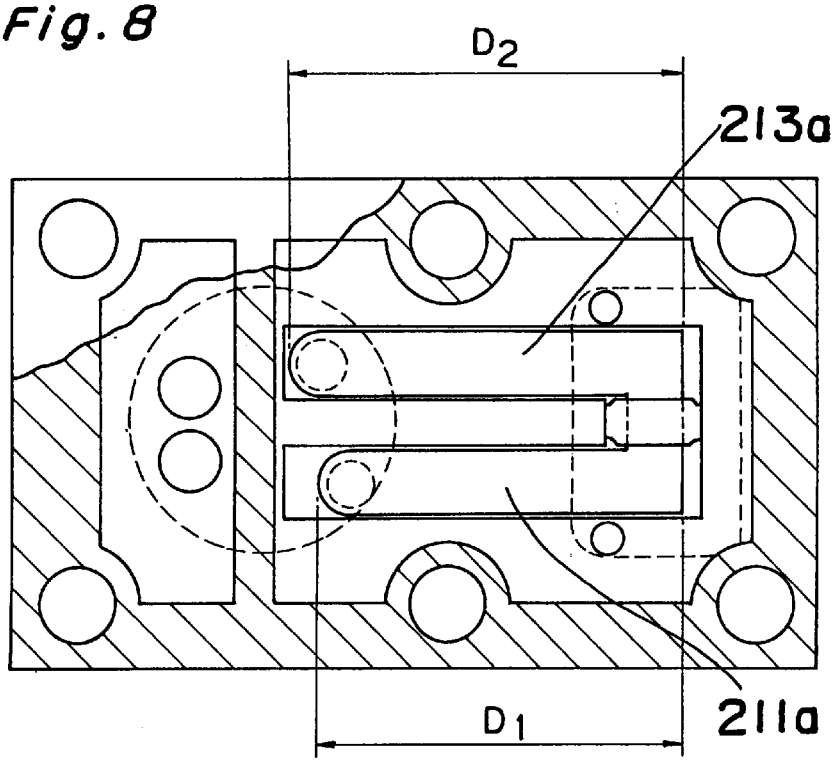
FIG. 8 is a view similar to FIG. 7, but depicting a modification thereof.

As shown in FIG. 8 illustrating a sectional diagram of an essential portion of the compressor valve mechanism, first and second discharge valves 211*a* and 213*a* may have different lengths D1 and D2 and, in view of the difference in length, they have different frequencies of vibration. The difference in frequency of vibration renders the resonance, produced by the discharge valves when the refrigerant is discharged, to be different and, therefore, a significant improvement of the discharge efficiency which would occur when resonance takes place can be properly adjusted to the different numbers of revolutions per minute. At the same time, an increase of the hissing sound resulting from interference of sound which is generated when they have their resonant frequencies close to each other can be avoided, thereby providing high efficiency and low noise.

It is to be noted that because a proper value can be chosen with respect to the number of revolutions per minute, it can bring about optimization at the high number of revolutions per minute and at the low number of revolutions when per minute an inverter drive is used out.

Also, because the proper value resulting from the resonance of the discharge valves varies relative to changes in flow resulting from changes in load, it has an effect of optimizing at a high load and also at a low load.

Figure 9:
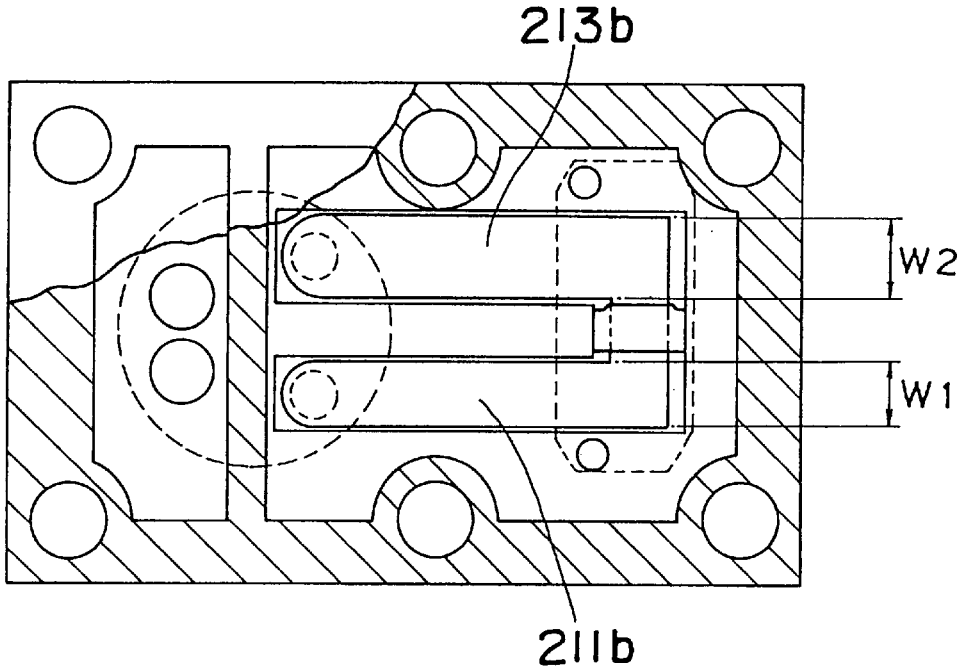
FIG. 9 is a view similar to FIG. 7, but depicting another modification thereof.

As shown in FIG. 9, first and second discharge valves 211*b* and 213*b* may have different widths W1 and W2 and, in view of the difference in width, they can have different frequencies of vibration. The difference in frequency of vibration renders the resonance, produced by the discharge valves when the refrigerant is discharged, to be different and, therefore, a significant improvement of the discharge efficiency which would occur when resonance takes place can be properly adjusted to the different numbers of revolutions. At the same time, an increase of the hissing sound resulting from interference of sound which is generated when they have their resonant frequencies close to each other can be avoided, thereby providing high efficiency and low noise.

It is to be noted that because a proper value can be chosen with respect to the number of revolutions per minute, it can bring about optimization at the high number of revolutions per minute and at the low number of revolutions when an inverter drive is used.

Also, because the proper value resulting from the resonance of the discharge valves varies relative to changes in flow resulting from changes in load, it has an effect of optimizing at a high load and also at a low load.

Figure 10:
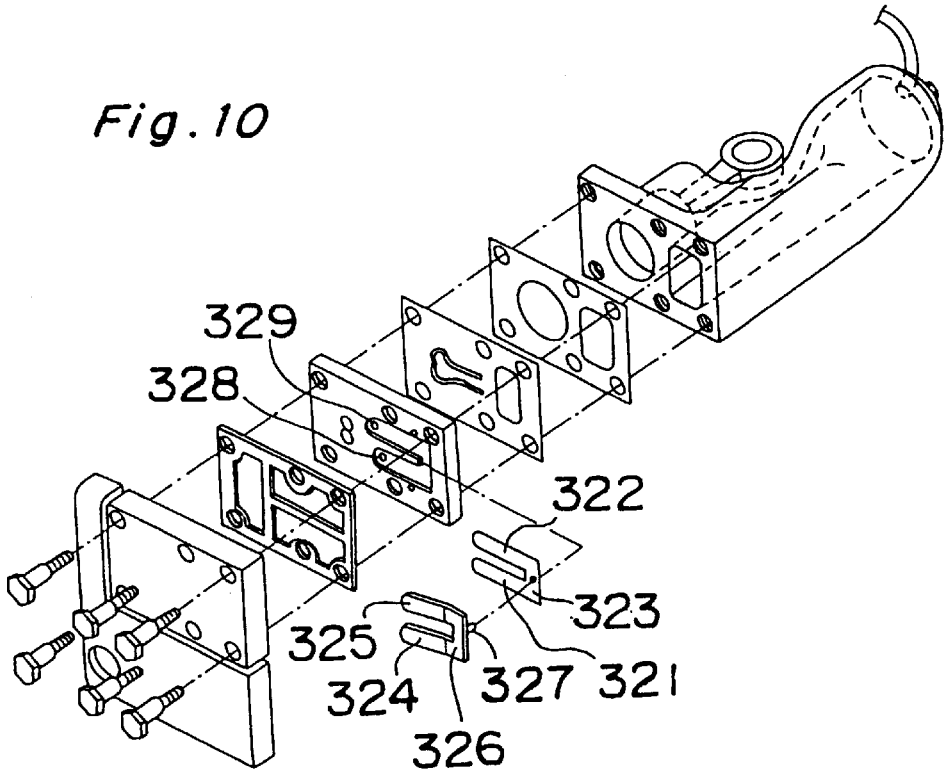
FIG. 10 is a view similar to FIG. 6, but depicting a modification thereof.

FIG. 10 illustrates an exploded view of a modification of the compressor valve mechanism of the present invention Reference numeral 321 represents a first discharge valve, and reference numeral 322 represents a second discharge valve connected with the first discharge valve 321 at a valve end 323 and formed integrally therewith. First and second stoppers 324 and 325 are connected at a stopper end 326 and formed integrally with each other. By fixing the valve end 323 by means of a set pin 327 formed on the stopper end 326, the first discharge valve 321 has its lift regulated by the first stopper 324, while the second discharge valve 322 has its lift regulated by the second stopper 325. Accordingly, mere securement of the stopper end 326 makes it possible to extremely easily regulate the lift of each of the first and second discharge valves 321 and 322. At the same time, the first and second discharge valves 321 and 322 can be installed at respective positions aligned with first and second discharge ports 328 and 329, bringing about such an effect that assembly can be effectively and easily accomplished.

Figure 11:
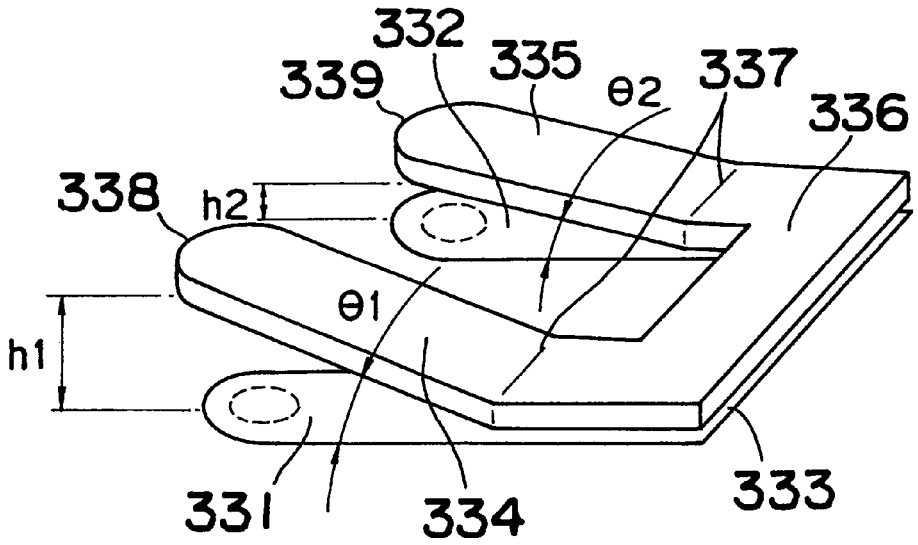
FIG. 11 is a perspective view of an essential portion of the valve mechanism.

The valve mechanism may be of a constriction as shown in FIG. 11. In FIG. 11, reference numeral 331 represents a first discharge valve, and reference numeral 332 represents a second discharge valve connected with the first discharge valve 331 at a valve end 333 and formed integrally therewith. First and second stoppers 334 and 335 are connected at a stopper end 336 and formed integrally with each other with the valve end 333 fixed. The first and second stoppers 334 and 335 have bent portions 337 bent at respective angles θ1 and θ2 so that their lifts can be h1 and h2 at respective ends 338 and 339.

Because the first and second discharge valves 331 and 332 have different lifts, the behavior of the refrigerant gas when the latter is discharged is different and, by providing lifts appropriate to the numbers of revolutions or performances, the discharge efficiency can be optimized. Also, an increase of the fluid sound resulting from interference which would occur when the first and second discharge valves 331 and 332 undergo similar behaviors can be prevented.

Figure 12:
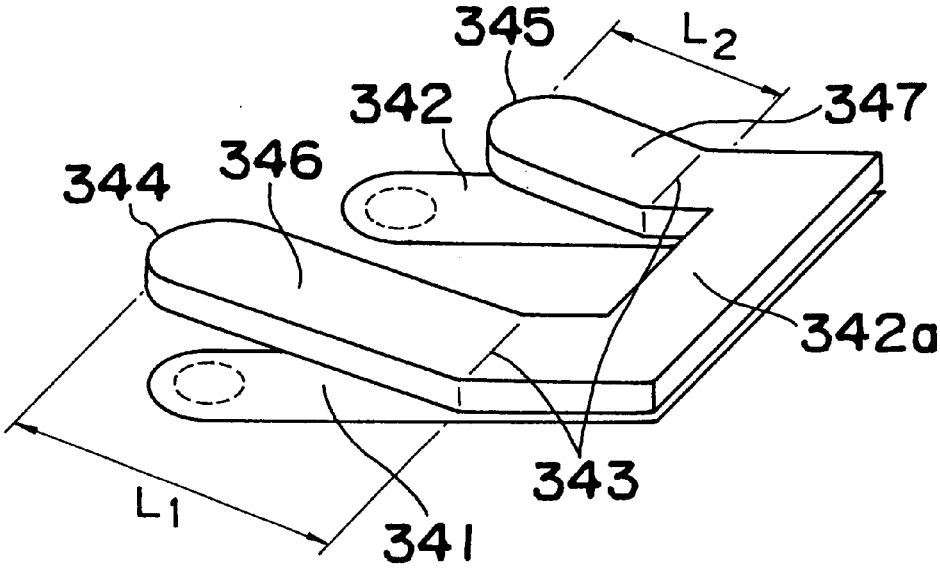
FIG. 12 is a view similar to FIG. 11, but depicting a modification thereof.

The valve mechanism may be of a construction as shown in FIG. 12. In FIG. 12, reference numeral 341 represents a first discharge valve, and reference numeral 342 represents a second discharge valve, and lifts are regulated by first and second stoppers 346 and 347 of different lengths L1 and L2 as measured from bent portions 343 of their stopper ends 342*a* to their free ends 344 and 345. In view of the first and second stoppers 346 and 347 having the different lengths, respective positions at which the first and second discharge valves 341 and 342 contact the associated stoppers when the refrigerant gas is discharged are different. Therefore, respective behaviors of the first and second discharge valves 341 and 342 when the refrigerant gas is discharged are different, and by providing the behaviors appropriate to the numbers of revolutions or performance, the discharge efficiency can be optimized. Also, an increase of the fluid sound resulting from interference which would occur when the first and second discharge valves 341 and 342 undergo similar behaviors can be prevented.

Figure 13:
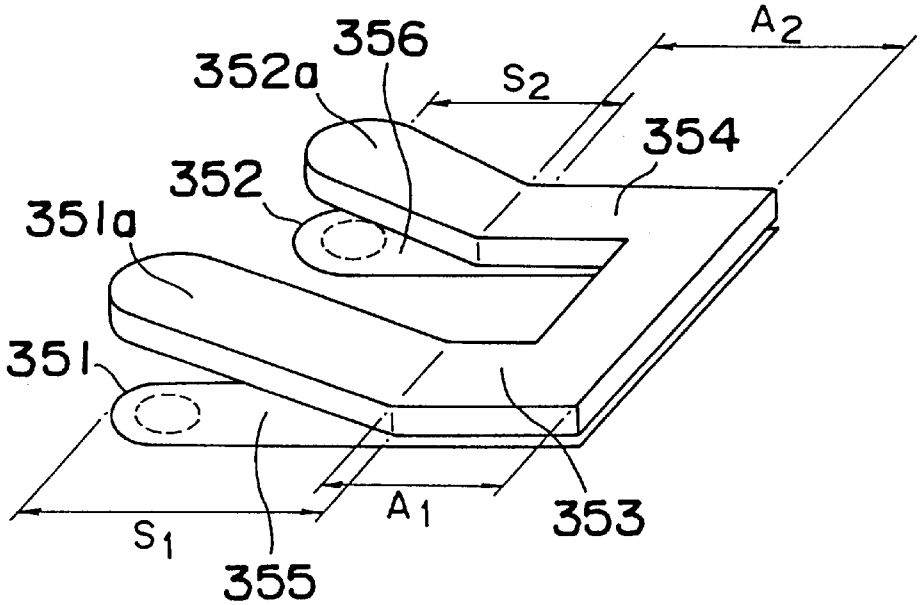
FIG. 13 is a view similar to FIG. 11, but depicting another modification thereof.

Alternatively, the valve mechanism is of a construction as shown in FIG. 13. In FIG. 13, reference numeral 351 represents a first discharge valve and reference numeral 352 represents a second discharge valve. A retaining portion 353 of a first stopper 351*a* and a retaining portion 354 of a second stopper 352*a* have different lengths Al and A2, respectively. In view of this, respective lengths S1 and S2 of effective valve portions 355 and 356 of the associated discharge valves are different from each other whereby the discharge valves have different frequencies of vibration. The difference in frequency of vibration renders the resonance, produced by the discharge valves when the refrigerant is discharged, to be different and, therefore, improvement of the discharge efficiency which would occur when resonance takes place can be properly adjusted to the different numbers of revolutions. At the same time, an increase of the hissing sound resulting from interference of sound which is generated when they have their resonant frequencies close to each other can be avoided, thereby providing a high efficiency and low noise.

It is to be noted that because a proper value can be chosen with respect to the number of revolutions, it can bring about optimization at the high number of revolutions per minute at low number of revolutions per minute when an inverter drive is used.

Also, because the proper value resulting from the resonance of the discharge valves varies relative to changes in flow resulting from changes in load, it has an effect of optimizing at a high load and also at a low load.

Figure 14:
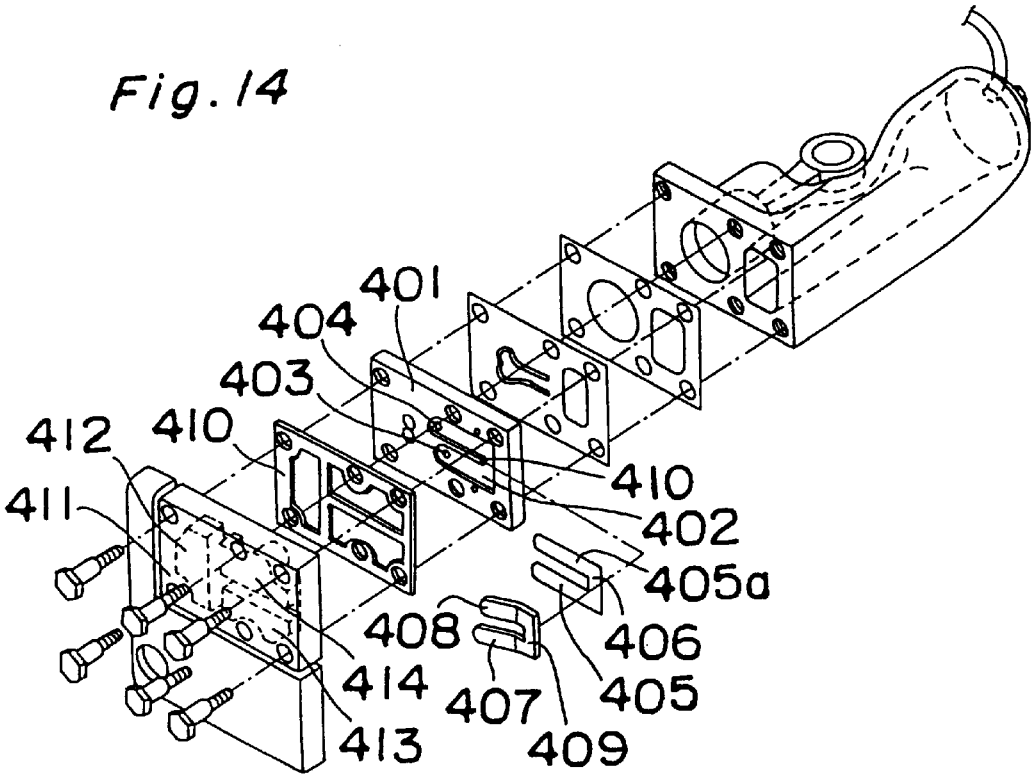
FIG. 14 is a view similar to FIG. 6, but depicting another modification thereof.
Figure 15:
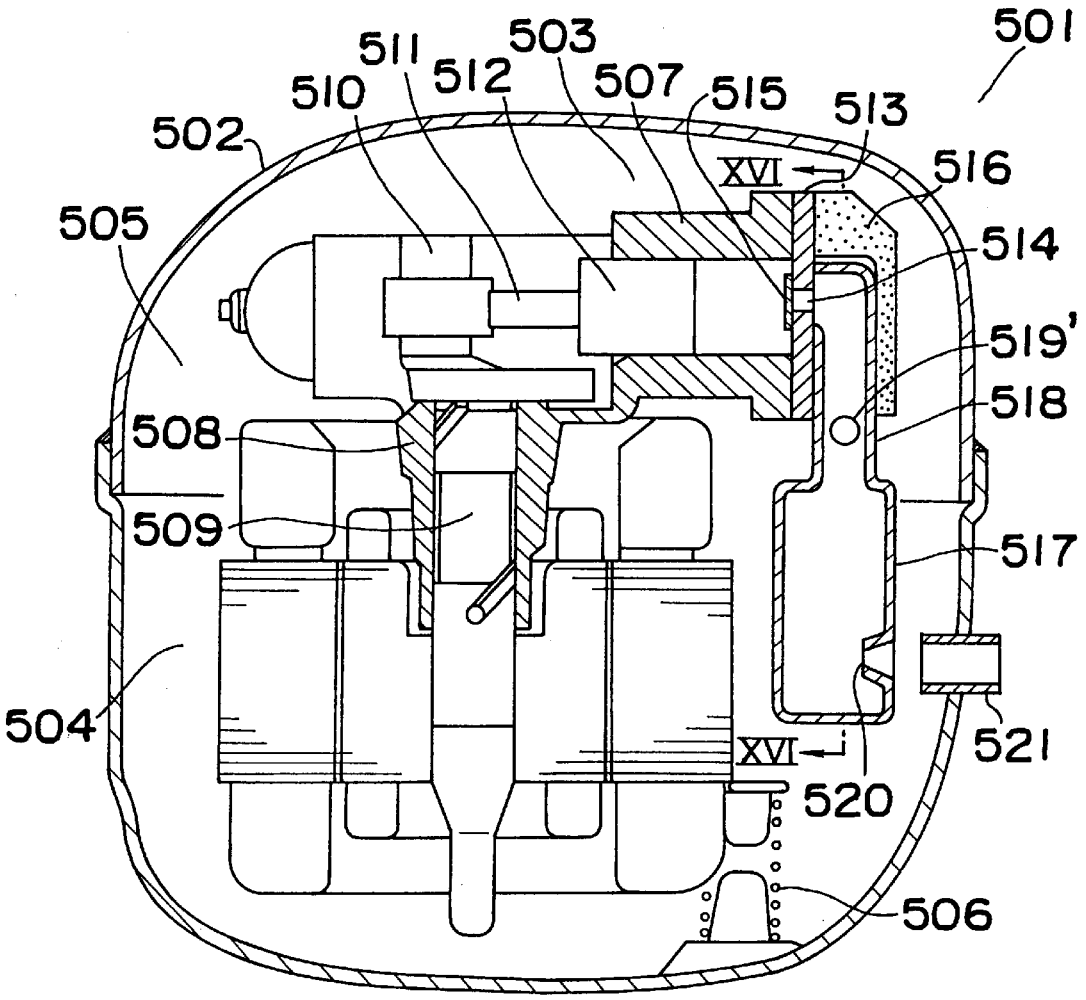
FIG. 15 is a sectional view of an electrically-operated sealed compressor according to a third embodiment of the present invention.
Figure 16:
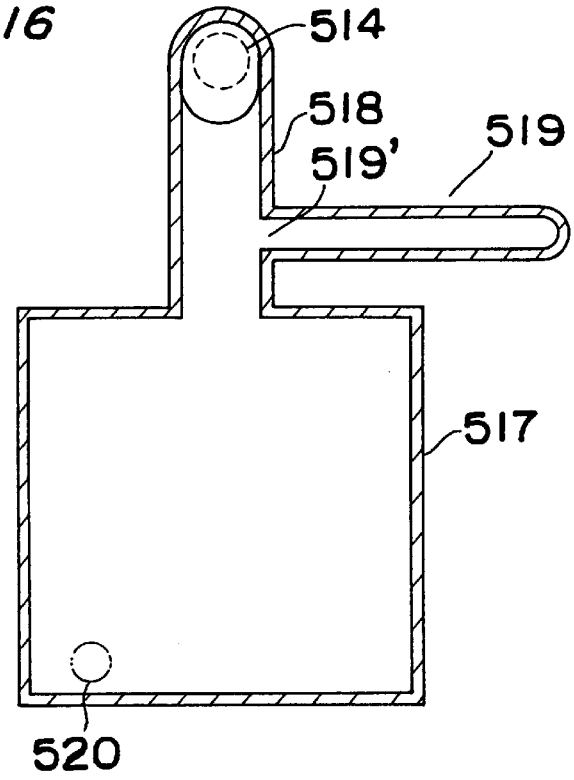
FIG. 16 is a sectional view taken along line XVI—XVI in FIG. 15.

FIG. 14 illustrates an exploded view of another modification of the compressor valve mechanism of the present invention. First and second discharge ports 403 and 404 are defined in a recess 402 in a valve plate 401, and first and second discharge valves 405 and 405*a* are arranged within the recess 402 in the form as connected at a valve end and formed integrally with each other.

First and second stoppers 407 and 408 are connected at a stopper end 409 and are formed integrally, and the valve end 406 is fixed within the recess 402 by pressing the valve end 406 by means of a fastening portion 410 of the recess 402 to thereby allow the relative positions of the first discharge valve 405 and the first discharge port 403 to be determined and also allow the lift of the first discharge valve 405 to be determined by the first stopper 407. Likewise, the relative positions of the second discharge valve 405*a* and the second discharge port 404 are determined and the lift of the second discharge valve 405*a* is determined by the second stopper 408. In addition, by rendering the recess 402 to have a depth equal to the sum of the stopper end 409 and the valve end 406, the stopper end 409 can be press-fitted and formed on the same plane as the valve plate 401. A suction chamber 412, a first discharge chamber 413 and a second discharge chamber 414 can be formed in a cylinder head 411 by the valve plate 401, the stopper end 409 and a discharge gasket 410.

Thus, by press-fitting the valve end 406 in the recess 402 by means of the stopper end 409, within two discharge chambers, discharge ports and discharge valves, one for each discharge chamber, can easily be formed, exhibiting excellent performance. Also, the hissing sounds of the refrigerant resulting from selective opening and closing of the first discharge valve 405 are generated within the first discharge chamber 413, while the hissing sounds of the refrigerant resulting from selective opening and closing of the second discharge valve 405*a* are generated within the second discharge chamber 414. Because both of them do not interfere with each other, generation of abnormal sounds resulting from the interference of the refrigerant sounds can be eliminated.

As hereinabove described, according to the present invention, the compressor valve mechanism in which mounting of the discharge valves is easy, accompanied by a favorable workability can be obtained.

Also, the compressor valve mechanism capable of exhibiting a favorable discharge efficiency and minimizing noises of interference of the refrigerant gases and, hence, minimizing noise emission can be obtained.

Also, the compressor valve mechanism wherein the first and second discharge valves and the first and second stoppers can easily be fixed can be obtained.

Embodiment 3

Hereinafter, a third embodiment of the present invention will be described with reference to FIGS. 15 to 19.

Reference numeral 501 represents an electrically-operated sealed compressor in which compressor elements 503 and a compressor unit 505 integrated with an electric motor 504 are elastically supported within upper and lower regions of a sealed casing 502 by means of springs 506.

Reference numeral 507 represents a cylinder block wherein a crankshaft 509 is supported by a bearing 508 and a piston 512 is connected to an eccentric portion 510 thereof by means of a connecting rod 511. Reference numeral 513 represents a valve plate provided with a suction port 514 and a discharge port (not shown), and reference numeral 515 represents a reed valve for selectively opening and closing the suction port 514. Reference numeral 516 represents a cylinder head.

Reference numeral 517 represents a suction muffler coupled in a passage 518 extending from the suction port 514 to the suction muffler 517. Reference numeral 519 represents a refrigerant flow branch tube provided so as to open into a portion 519' of the passage 518. Reference numeral 520 represents a refrigerant intake port of the suction muffler 517. Reference numeral 521 represents a suction pipe extending through the sealed casing 502 so as to confront the refrigerant intake port 520.

The operation of the electrically-operated sealed compressor constructed as hereinabove described will now be described.

When the reed valve 515 is open during a suction stroke of the compressor 501, the refrigerant gas flows from the suction muffler 517 into the cylinder through the passage 518. When the piston 512 elevates into a compression stroke, the reed valve 515 is closed to abruptly interrupt the flow of the suction gas within the tube 517, accompanied by an increase in internal pressure, allowing the flow from the opening 519' into the refrigerant flow branch tube 519.

During the subsequent suction stroke, a negative pressure is developed within the cylinder to allow the refrigerant gas to be immediately supplied from the refrigerant flow branch tube 519 so that the refrigerant can efficiently be charged into the cylinder without loosing the flow inertia of the refrigerant.

Accordingly, there is no possibility that the efficiency of charge into the cylinder becomes worse as a result of the intermittent flow of the sucked refrigerant gas such as occurring in the prior art and the suction efficiency can be maintained and improved.

Figure 17:
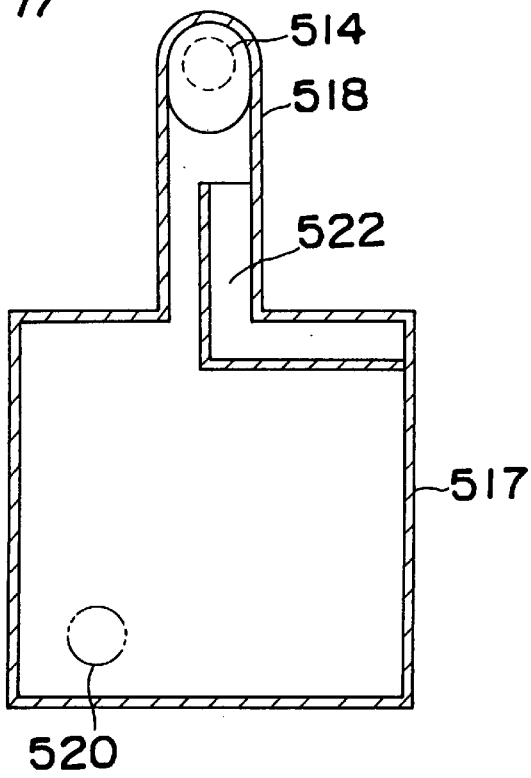
FIG. 17 is a view similar to FIG. 16, but depicting a modification thereof.

As shown in FIG. 17, a refrigerant flow branch tube 522 may be accommodated within the suction muffler 517, and this can simplify the structure of the muffler 517 along with improving in suction efficiency.

Figure 18:
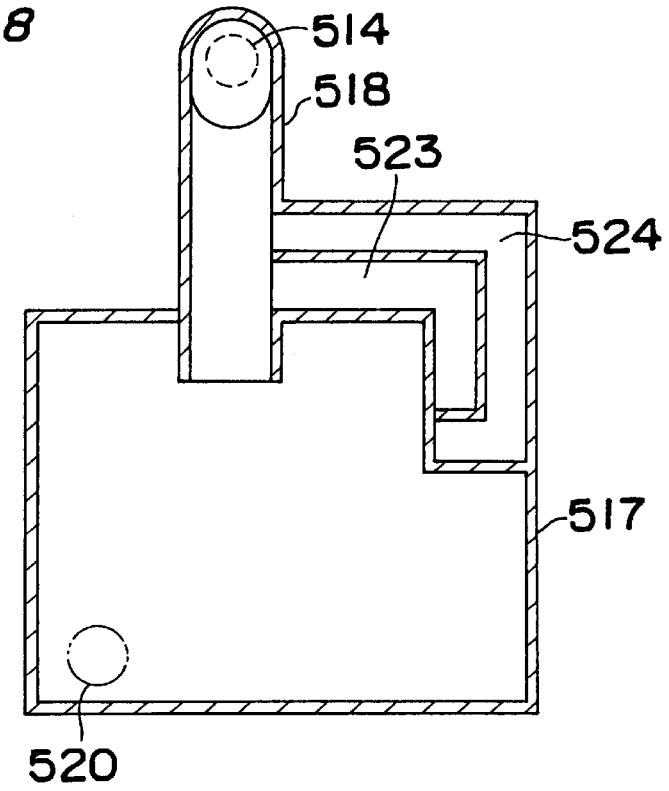
FIG. 18 is a view similar to FIG. 16, but depicting another modification thereof.

Alternatively, as shown in FIG. 18, refrigerant flow branch tubes 523 and 524 of different lengths are structured integrally with the suction muffler 517 and connected with the passage 518.

In such case, where the number of revolutions per minute of the electrically-operated sealed compressor is, for example, 50 Hz and 60 Hz, it is assumed that the shorter refrigerant flow branch tube 523 and the longer refrigerant flow branch tube 524 are tuned to 60 Hz and 50 Hz, respectively. Gas columns within the tuned refrigerant flow branch tubes 523 and 524 resonate at the respective numbers of revolutions. During closure of the reed valve 515, the refrigerant gas is charged in the refrigerant flow branch tubes 523 and 524, but during opening of the reed valve 515, the function of the refrigerant flow branch tubes 523 and 524 are accelerated in synchronism with the cycle of flow into the cylinder.

By so doing, with the single muffler structure, an optimum suction efficiency can be improved at a plurality of number of revolutions.

It is to be noted that in the foregoing description, the refrigerant flow branch tubes 523 and 524 have been accommodated within the muffler 517, similar effects can be obtained even though they are structured separately.

Figure 19:
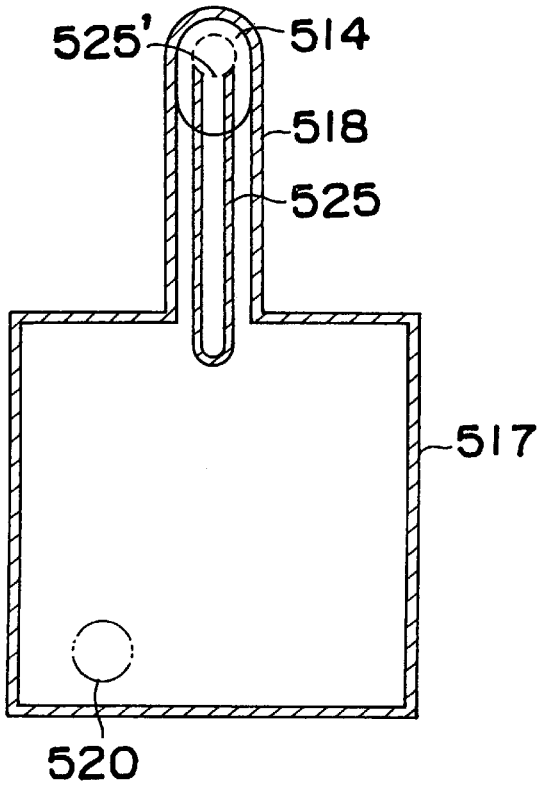
FIG. 19 is a view similar to FIG. 16, but depicting a further modification thereof.

Alternatively, as shown in FIG. 19, a refrigerant flow branch tube 525 may be accommodated within the suction muffler 517 and opens at 525' in the vicinity of or adjacent to the suction port 514.

By so doing, the flow inertia of the sucked refrigerant gas can be maintained and improved in the vicinity of the suction port 514, and the time lag which would occur when the refrigerant gas is charged into the cylinder after having passed from the refrigerant flow branch tube 525 through the suction port 514 during the opening of the reed valve 515 can be minimized to further improve the suction efficiency.

It is to be noted that in the foregoing description, the refrigerant flow branch tube 525 has been accommodated within the muffler 517, similar effects can be obtained even though they are structured separately.

In FIGS. 15 to 19, the refrigerant intake port 520 of the suction muffler 517 is formed so as to have a cross-sectional area smaller than the suction port 514.

By the effect of maintenance and improvement of the flow inertia of the refrigerant flow branch tubes 519, 522, 523, 524 and 525, noise can be effectively reduced by throttling the section of the refrigerant intake port 520 which is an outlet for emission of noise into the sealed casing 502, without causing the efficiency of charge of the refrigerant into the cylinder to become worse.

As hereinbefore described, according to the present invention, the intermittent flow phenomenon of the refrigerant gas hitherto observed can be lessened and the flow inertia can be maintained and improved, resulting in an improvement in suction efficiency.

Also, by integrating the suction muffler and the refrigerant flow branch tube together, the structure can be simplified.

In addition, by structuring the plural refrigerant flow branch tubes appropriate to the respective numbers of revolutions per minute, an optimum suction efficiency appropriate to the particular number of revolutions can be obtained.

Also, by causing the refrigerant flow branch tube to open in the vicinity of the suction port, the suction efficiency can further be improved.

Yet, by rendering the refrigerant intake port of the suction muffler to be smaller than the suction port, noise can effectively be reduced while maintaining the suction efficiency.

Thus, as compared with the prior art electrically-operate compressor, advantageous effects of a high efficiency and low noise can be obtained.

Embodiment 4

Hereinafter, a fourth embodiment of the present invention will be described with reference to FIGS. 15 and 20 to 23.

Figure 20:
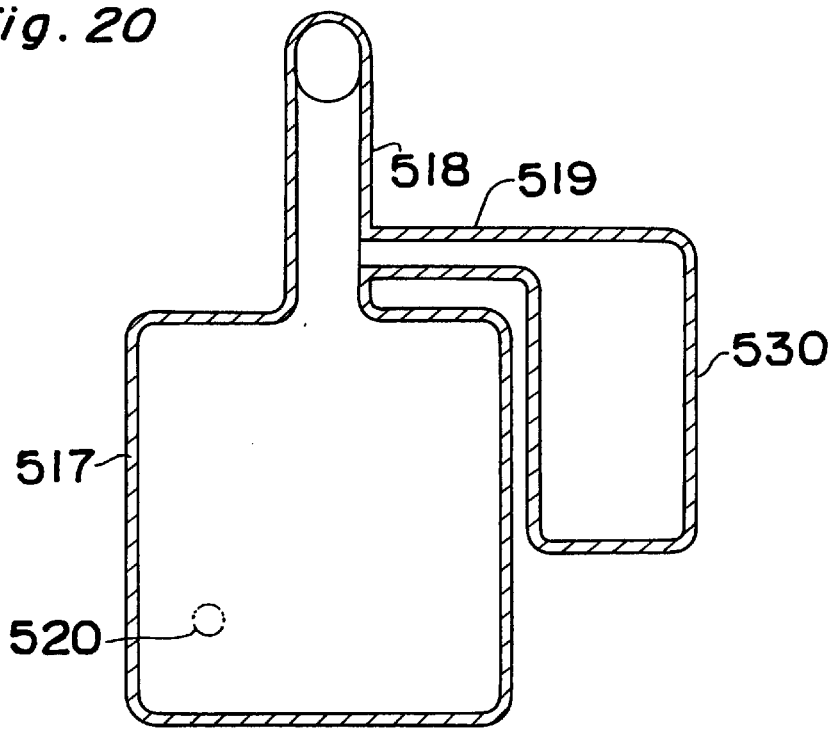
FIG. 20 is a view similar to FIG. 16, but according to a fourth embodiment of the present invention.

In FIG. 20, reference numeral 19 represents a refrigerant flow branch tube provided on the passage 518 and having a terminating end coupled with a closed small chamber 530.

To describe the operation of the electrically-operated sealed compressor constructed as hereinabove described, when the reed valve 515 is opened during a suction stroke of the compressor 501, the refrigerant gas flows from the suction muffler 517 into the cylinder through the passage 518. When the piston 512 elevates into a compression stroke, the reed valve 515 is closed to abruptly interrupt the flow of the suction gas within the passage 518, accompanied by an increase in internal pressure by the effect of a flow inertia to fill up the closed small chamber 530 through the branch tube 519. Accordingly, no upstream flow of the gas within the passage is halted. During the subsequent suction stroke, the gas within the closed small chamber 530 immediately flows into the branch tube 519. Accordingly, the lag time in which the flow of the sucked gas becomes discontinuous and no initial flow is sufficiently developed such as occurring in the prior art can be reduced, accompanied by an increase in suction efficiency.

Figure 21:
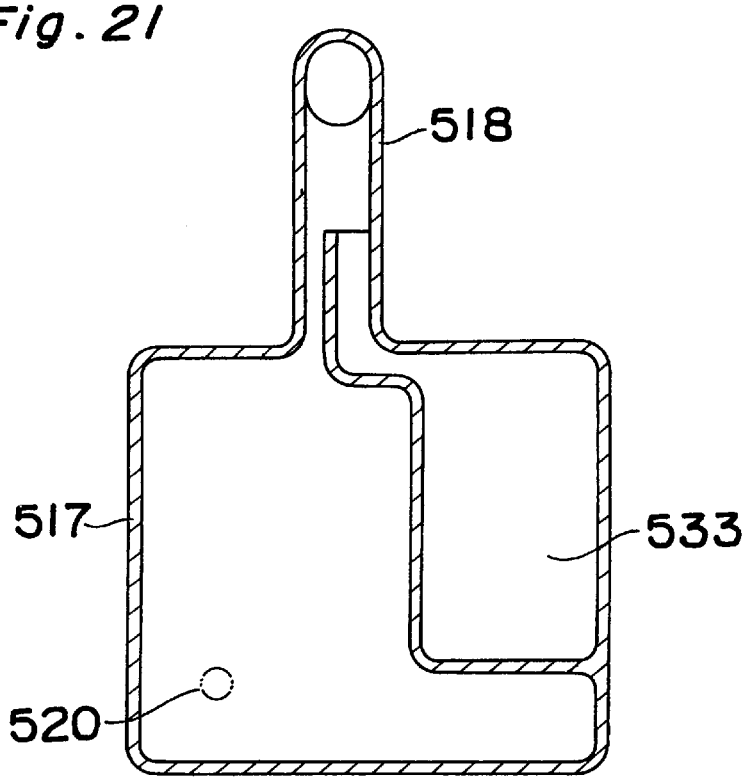
FIG. 21 is a view similar to FIG. 20, but depicting a modification thereof.

As shown in FIG. 21, a closed small chamber 533 may be accommodated within the suction muffler 517. This construction is effective to simplify the structure of the muffler in addition to improvement in suction efficiency.

Figure 22:
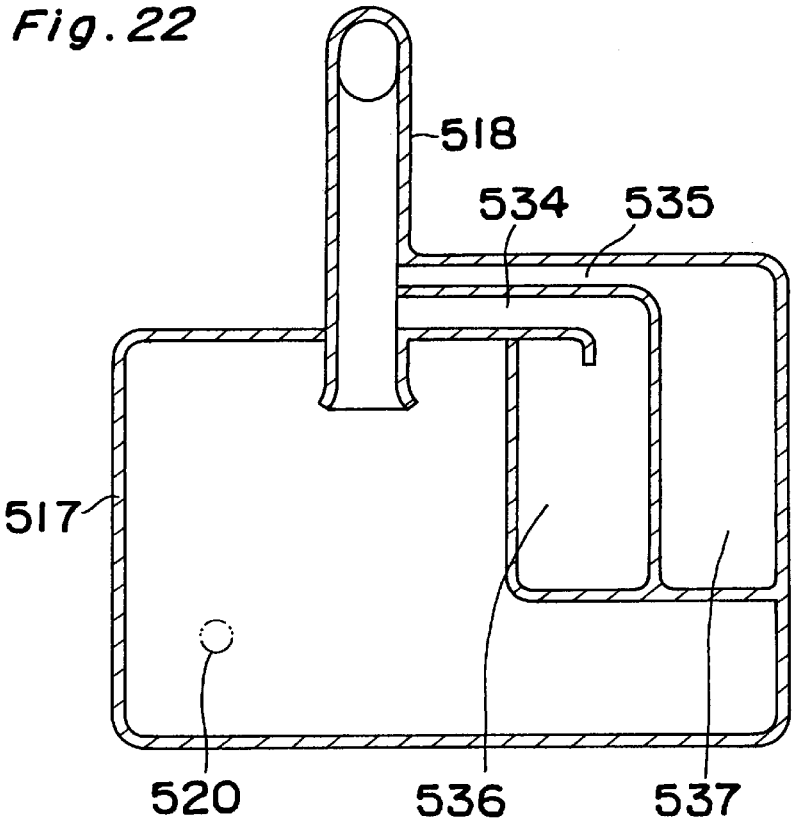
FIG. 22 is a view similar to FIG. 20, but depicting another modification thereof.

Alternatively, as shown in FIG. 22, refrigerant flow branch tubes 534 and 535 of different lengths and closed small chambers 536 and 537 of different volumes are integrally structured with the suction muffler 517 and coupled with the passage 518. In such a case, where the number of revolutions per minute of the compressor differs, with the single muffler structure, an optimum suction efficiency can be increased at a plurality of numbers of revolutions per minute. It is to be noted that the length and diameter of each of the branch tubes 534 and 535 and/or the volume of each of the closed small chambers may not be always limited to those described above and either of them may be changed.

Figure 23:
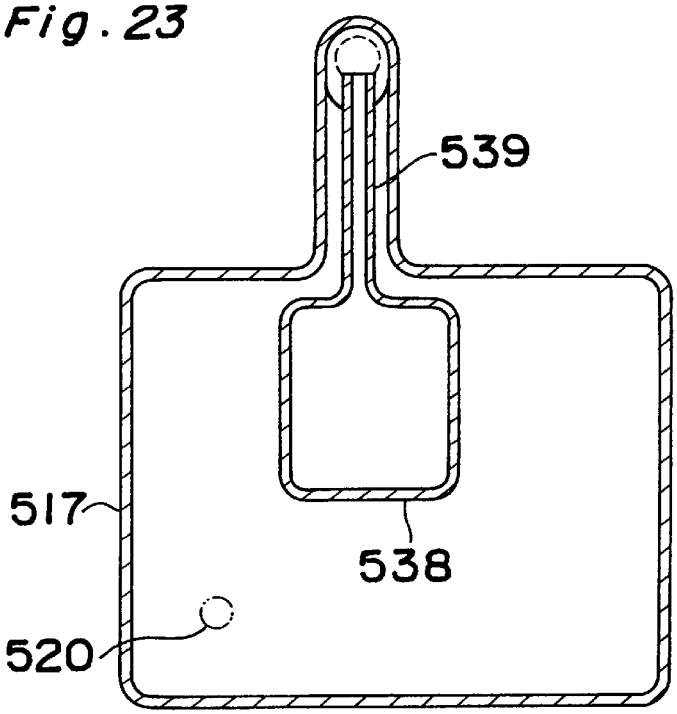
FIG. 23 is a view similar to FIG. 20, but depicting a further modification thereof.
Figure 24:
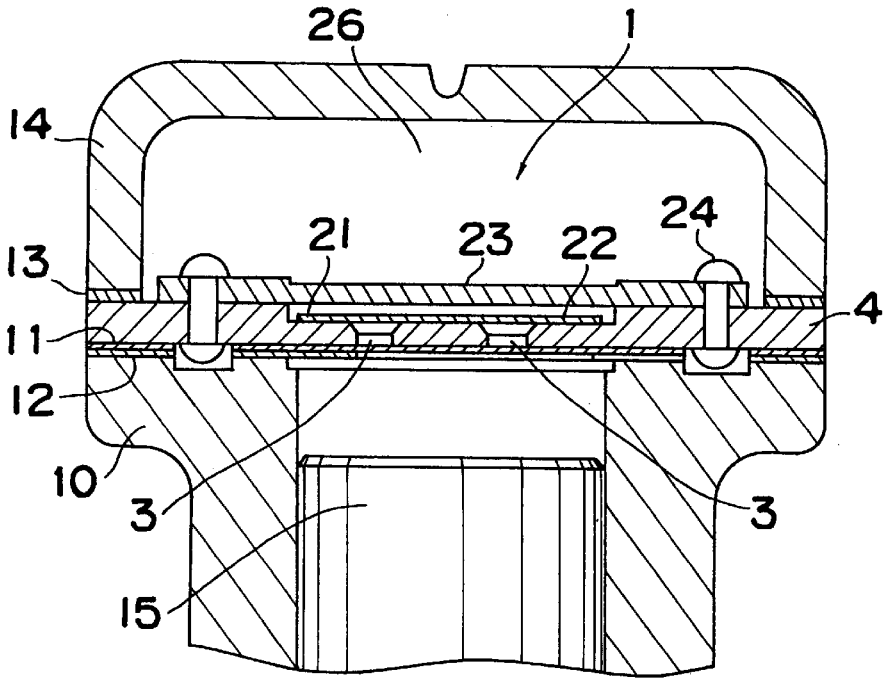
Fig. 24 PRIOR ART
FIG. 24 is a sectional view of an essential portion of a conventional compressor valve mechanism.
Figure 25:
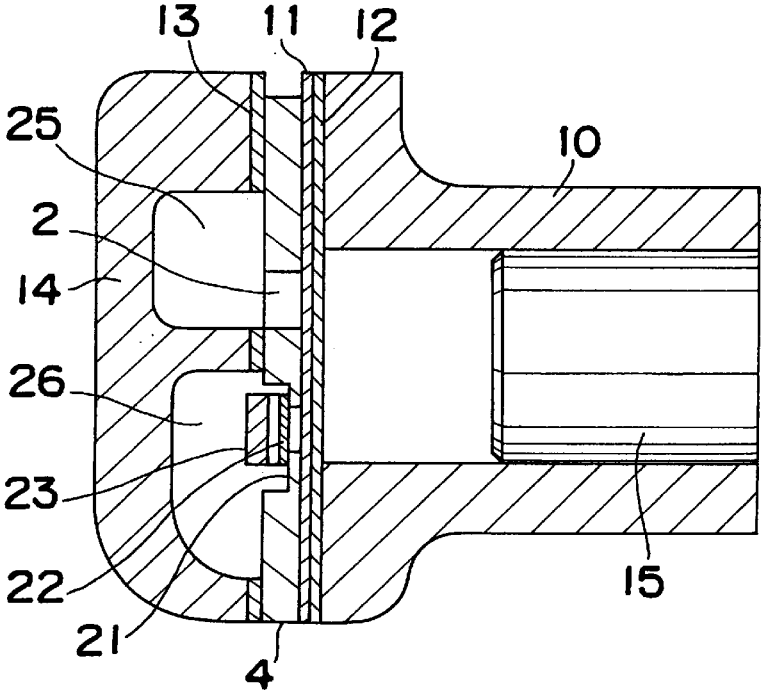
Fig. 25 PRIOR ART
FIG. 25 is another sectional view of the essential portion of the conventional compressor valve mechanism of FIG. 24.
Figure 26:
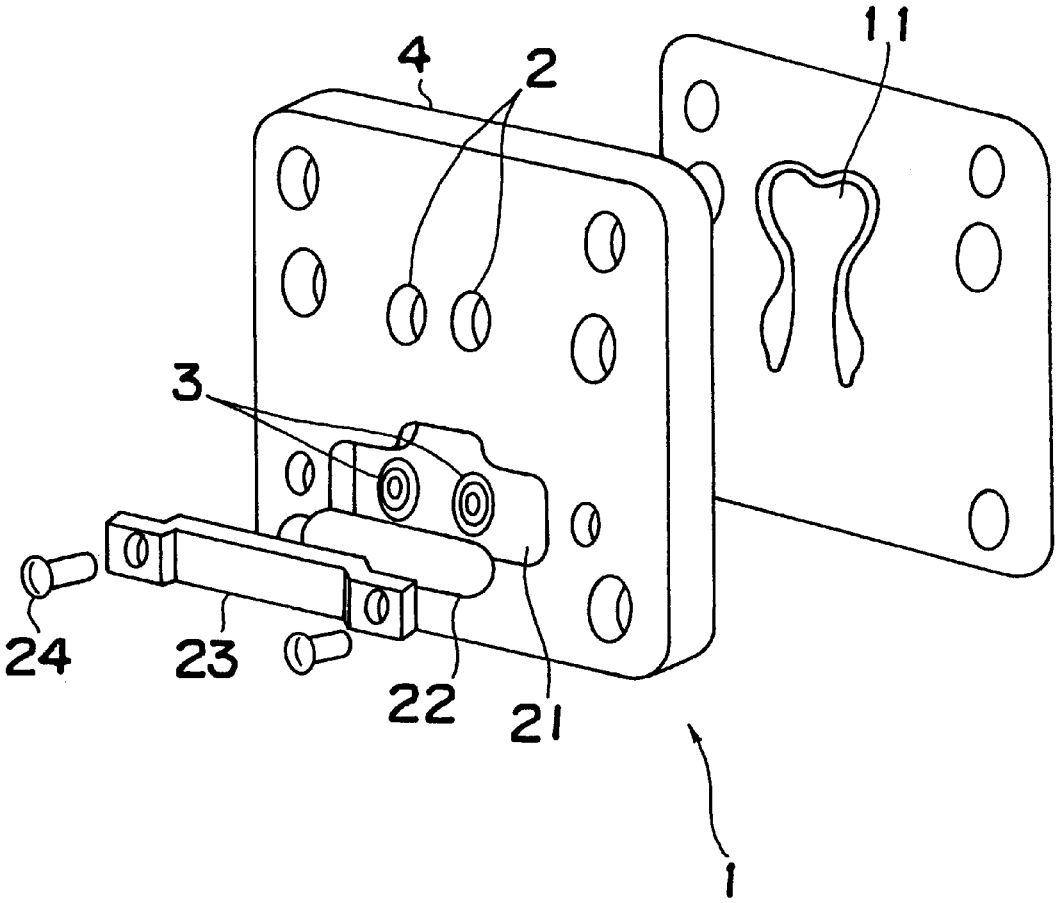
Fig. 26 PRIOR ART
FIG. 26 is an exploded perspective view of the essential portion of the conventional compressor valve mechanism of FIG. 24.

Again alternatively, as shown in FIG. 23, not only is a closed small chamber 538 accommodated within the suction muffler 517, but also a refrigerant flow branch tube 539 opens in the vicinity of the suction port 514. With this structure, any possible delay in flow of the gas can further be reduced.

Accordingly, because the suction efficiency can be increased, the performance will not be reduced or will be reduced even if the section of the intake port 520 of the suction muffler 517 is reduced. Accordingly, by throttling the section of the intake port 520 which provides an outlet through which noise is expelled into the sealed casing 502, the noise can be reduced.

As hereinabove described, according to this embodiment of the present invention, the discontinuity of the refrigerant gas hitherto observed in the prior art suction system can be lessened and the suction efficiency can be increased, accompanied by an improvement in muffling performance of the muffler.

If the closed small chamber is disposed within the suction muffler, the structure of the suction muffler can be simplified. Also, if the closed small chamber is so structured as to correspond with the number of revolutions per minute, the optimum efficiency can be increased at the plural numbers of revolutions per minute. Moreover, by disposing an opening of the closed small chamber in the vicinity of the suction port, the effect thereof can further be increased. Yet, because in terms of performance the cross-sectional area of the intake port of the suction muffler can be reduced to a value smaller than the suction port, the muffling performance can be sufficiently increased to provide a quiet compressor having a high performance.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

We claim:

1. An electrically-operated sealed compressor comprising:

a sealed casing;

a plurality of compressor elements, including an electric motor, a cylinder, a piston provided in said cylinder, and a crankshaft, accommodated in said sealed casing;

a suction muffler accommodated in said sealed casing;

a passage extending between said suction muffler and one of said compressor elements;

a valve plate mounted on said one of said compressor elements, said valve plate having a suction port defined therein and said suction port extends between said passage and said one of said compressor elements;

a reed valve for selectively opening and closing said suction port; and a refrigerant flow branch tube opening into a portion of said passage, such that when said reed valve is closed at a compression stroke of said piston in said cylinder, an internal pressure of said passage is increased to allow a gas to flow into said refrigerant flow branch tube, and when said reed valve is opened at a subsequent suction stroke of said piston in said cylinder, the gas drawn into said refrigerant flow branch tube is immediately supplied into said cylinder through said suction port, without losing a flow inertia of the gas.

2. The electrically-operated sealed compressor according to claim 1, wherein said refrigerant flow branch tube is accommodated in said suction muffler.

3. The electrically-operated sealed compressor according to claim 1, further comprising a second refrigerant flow branch tube opening into a second portion of said passage.

4. The electrically-operated sealed compressor according to claim 1, wherein said refrigerant flow branch tube has an opening disposed adjacent to said suction port.

5. The electrically-operated sealed compressor according to claim 1, wherein said suction muffler has a refrigerant intake port having a cross-sectional area smaller than said suction port.

6. An electrically-operated sealed compressor comprising:

a sealed casing;

a plurality of compressor elements, including an electric motor, a cylinder, a piston provided in said cylinder, and a crankshaft, accommodated in said sealed casing;

a suction muffler accommodated in said sealed casing;

a passage extending between said suction muffler and one of said compressor elements;

a valve plate mounted on said one of said compressor elements, said valve plate having a suction port defined therein and said suction port extends between said passage and said one of said compressor elements;

a reed valve for selectively opening and closing said suction port; and a closed small chamber formed so as to open into said passage through a branch tube, such that when said reed valve is closed at a compression stroke of said piston in said cylinder, an internal pressure of said passage is increased to allow a gas to flow into said small chamber through said branch tube, and when said reed valve is opened at a subsequent suction stroke of said piston in said the gas drawn into said small chamber is immediately supplied into said cylinder through said suction port, without losing a flow inertia of the gas.

7. The electrically-operated sealed compressor according to claim 6, further comprising a second closed small chamber formed so as to open into said passage through a second branch tube.

8. The electrically-operated sealed compressor according to claim 6, wherein said closed small chamber is accommodated in said suction muffler.

9. The electrically-operated sealed compressor according to claim 6, wherein said closed small chamber is open into said passage adjacent to said suction port.

10. The electrically-operated sealed compressor according to claim 6, wherein said suction muffler has an intake port defined therein and having a cross-sectional area smaller than said suction port.

* * * * *